US008870679B2

(12) United States Patent
Oldknow

(10) Patent No.: US 8,870,679 B2
(45) Date of Patent: Oct. 28, 2014

(54) GOLF CLUB ASSEMBLY AND GOLF CLUB WITH AERODYNAMIC FEATURES

(75) Inventor: Andrew G. V. Oldknow, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 210 days.

(21) Appl. No.: 13/485,019

(22) Filed: May 31, 2012

(65) Prior Publication Data

US 2013/0324294 A1 Dec. 5, 2013

(51) Int. Cl.
*A63B 53/08* (2006.01)

(52) U.S. Cl.
USPC ..... 473/344; 473/335; 473/341; 473/345

(58) Field of Classification Search
CPC ..... A63B 2053/0433; A63B 2053/0491; A63B 53/08
USPC ..... 473/337, 336, 341, 344, 345, 335
See application file for complete search history.

(56) References Cited

U.S. PATENT DOCUMENTS

| | | | |
|---|---|---|---|
| 1,587,758 | A | 6/1926 | Charavay |
| 4,444,392 | A | 4/1984 | Duclos |
| D275,412 | S | 9/1984 | Simmons |
| 4,653,756 | A | 3/1987 | Sato |
| 4,850,593 | A | 7/1989 | Nelson |
| D307,783 | S | 5/1990 | Iinuma |
| 5,054,784 | A | 10/1991 | Collins |
| 5,120,061 | A | 6/1992 | Tsuchida et al. |
| 5,158,296 | A | 10/1992 | Lee |
| 5,190,289 | A | 3/1993 | Nagai et al. |
| 5,193,810 | A | 3/1993 | Antonious |
| 5,203,565 | A | 4/1993 | Murray et al. |
| 5,221,086 | A | 6/1993 | Antonious |
| 5,240,252 | A | 8/1993 | Schmidt et al. |
| 5,271,622 | A | 12/1993 | Rogerson |
| 5,318,297 | A | 6/1994 | Davis et al. |
| 5,435,558 | A | 7/1995 | Iriarte |
| 5,465,970 | A | 11/1995 | Adams et al. |
| 5,505,448 | A | 4/1996 | Park |
| 5,511,786 | A | 4/1996 | Antonious |
| 5,524,890 | A | 6/1996 | Kim et al. |
| 5,544,884 | A | 8/1996 | Hardman |
| 5,575,725 | A | 11/1996 | Olsavsky |

(Continued)

FOREIGN PATENT DOCUMENTS

| | | | |
|---|---|---|---|
| JP | 2009000281 | A | 1/2009 |
| WO | 2010028114 | A2 | 3/2010 |
| WO | 2010104898 | A2 | 9/2010 |

OTHER PUBLICATIONS

Adamsgolf, Speedline Driver advertisement, Golf World magazine, Mar. 9, 2009, p. 15.

*Primary Examiner* — Benjamin Layno
(74) *Attorney, Agent, or Firm* — Banner & Witcoff Ltd.

(57) ABSTRACT

A golf club includes a shaft and a club head. The club head includes a body member having a ball striking face, a heel, a toe, a back, a crown, a sole, and a hosel region located at the intersection of the ball striking face, the heel and the crown. The sole includes a channel extending from the hosel region toward the toe. An insert is received within the channel. The club head further includes means for detachably securing the insert to the channel. A second insert configured for being received within the channel may be provided.

30 Claims, 10 Drawing Sheets

(56) References Cited

U.S. PATENT DOCUMENTS

| | | | | |
|---|---|---|---|---|
| 5,643,107 | A | 7/1997 | Gorman | |
| 5,681,227 | A | 10/1997 | Sayrizi | |
| 5,720,674 | A * | 2/1998 | Galy | 473/345 |
| 5,735,754 | A | 4/1998 | Antonious | |
| 5,785,609 | A | 7/1998 | Sheets et al. | |
| D398,681 | S | 9/1998 | Galy | |
| 5,803,830 | A | 9/1998 | Austin et al. | |
| 5,873,793 | A | 2/1999 | Swinford | |
| 5,913,733 | A | 6/1999 | Bamber | |
| 5,921,870 | A | 7/1999 | Chiasson | |
| 5,954,595 | A | 9/1999 | Antonious | |
| 5,961,397 | A | 10/1999 | Lu et al. | |
| 5,980,394 | A | 11/1999 | Domas | |
| 5,997,413 | A | 12/1999 | Wood, IV | |
| 5,997,415 | A | 12/1999 | Wood | |
| 6,017,280 | A | 1/2000 | Hubert | |
| 6,027,414 | A | 2/2000 | Koebler | |
| D421,472 | S | 3/2000 | Peterson | |
| 6,059,669 | A | 5/2000 | Pearce | |
| 6,074,308 | A | 6/2000 | Domas | |
| 6,077,171 | A * | 6/2000 | Yoneyama | 473/291 |
| 6,123,627 | A * | 9/2000 | Antonious | 473/327 |
| 6,319,148 | B1 | 11/2001 | Tom | |
| D470,202 | S | 2/2003 | Tunno | |
| 6,530,847 | B1 | 3/2003 | Antonious | |
| 6,561,922 | B2 | 5/2003 | Bamber | |
| 6,609,981 | B2 | 8/2003 | Hirata | |
| D481,430 | S | 10/2003 | Tunno | |
| 6,773,359 | B1 | 8/2004 | Lee | |
| 6,824,474 | B1 | 11/2004 | Thill | |
| 6,855,068 | B2 | 2/2005 | Antonious | |
| 6,890,267 | B2 | 5/2005 | Mahaffey et al. | |
| D509,869 | S | 9/2005 | Mahaffey | |
| 7,390,266 | B2 | 6/2008 | Gwon | |
| 7,524,249 | B2 | 4/2009 | Breier et al. | |
| 7,568,985 | B2 | 8/2009 | Beach et al. | |
| D608,850 | S | 1/2010 | Oldknow | |
| D609,296 | S | 2/2010 | Oldknow | |
| D609,297 | S | 2/2010 | Oldknow | |
| D609,764 | S | 2/2010 | Oldknow | |
| 7,713,138 | B2 | 5/2010 | Sato et al. | |
| 7,803,065 | B2 | 9/2010 | Breier et al. | |
| 2001/0027139 | A1 | 10/2001 | Saso | |
| 2002/0077194 | A1 | 6/2002 | Carr et al. | |
| 2002/0077195 | A1 | 6/2002 | Carr et al. | |
| 2002/0121031 | A1 | 9/2002 | Smith et al. | |
| 2003/0087710 | A1 | 5/2003 | Sheets et al. | |
| 2003/0220154 | A1 | 11/2003 | Anelli | |
| 2003/0232659 | A1 | 12/2003 | Mahaffey et al. | |
| 2003/0236131 | A1 | 12/2003 | Burrows | |
| 2004/0018891 | A1 | 1/2004 | Antonious | |
| 2004/0138002 | A1 | 7/2004 | Murray | |
| 2004/0229713 | A1 | 11/2004 | Helmstetter et al. | |
| 2005/0009622 | A1 | 1/2005 | Antonious | |
| 2005/0032584 | A1 | 2/2005 | Van Nimwegen | |
| 2005/0049073 | A1 | 3/2005 | Herber | |
| 2005/0153798 | A1 | 7/2005 | Rigoli | |
| 2005/0153799 | A1 | 7/2005 | Rigoli | |
| 2006/0014588 | A1 | 1/2006 | Page | |
| 2007/0149310 | A1 | 6/2007 | Bennett et al. | |
| 2008/0188320 | A1 | 8/2008 | Kamatari | |
| 2009/0124410 | A1 | 5/2009 | Rife | |
| 2009/0149276 | A1 | 6/2009 | Golden et al. | |
| 2009/0203465 | A1 | 8/2009 | Stites et al. | |
| 2009/0286618 | A1 | 11/2009 | Beach et al. | |
| 2010/0311517 | A1 | 12/2010 | Tavares et al. | |
| 2011/0009209 | A1* | 1/2011 | Llewellyn et al. | 473/336 |
| 2011/0136584 | A1* | 6/2011 | Boyd et al. | 473/327 |
| 2012/0142452 | A1* | 6/2012 | Burnett et al. | 473/345 |
| 2012/0196701 | A1* | 8/2012 | Stites et al. | 473/345 |

* cited by examiner

GOLF CLUB ASSEMBLY AND GOLF CLUB WITH AERODYNAMIC FEATURES

FIELD

Aspects of this invention relate generally to golf clubs and golf club heads, and, in particular, to a golf club and golf club head with aerodynamic features.

BACKGROUND

The distance a golf ball travels when struck by a golf club is determined in large part by club head speed at the point of impact with the golf ball. Club head speed in turn can be affected by the wind resistance or drag associated with the club head, especially given the large club head sizes of typical modern drivers. The club head of a driver, fairway wood, or metal wood in particular experiences significant aerodynamic drag during its swing path. The drag experienced by the club head leads to reduced club head speed and, therefore, reduced distance of travel of the golf ball after it has been struck.

Air flows in a direction opposite to the golf club head's trajectory over those surfaces of the golf club head that are roughly parallel to the direction of airflow. An important factor affecting drag is the behavior of the air flow's boundary layer. The "boundary layer" is a thin layer of air that lies very close to the surface of the club head during its motion. As the airflow moves over the surfaces, it encounters an increasing pressure. This increase in pressure is called an "adverse pressure gradient" because it causes the airflow to slow down and lose momentum. As the pressure continues to increase, the airflow continues to slow down until it reaches a speed of zero, at which point it separates from the surface. The air stream will hug the club head's surfaces until the loss of momentum in the airflow's boundary layer causes it to separate from the surface. The separation of the air streams from the surfaces results in a low pressure separation region behind the club head (i.e., at the trailing edge as defined relative to the direction of air flowing over the club head). This low pressure separation region creates pressure drag. The larger the separation region, the greater the pressure drag.

One way to reduce or minimize the size of the low pressure separation region is by providing a streamlined form that allows laminar flow to be maintained for as long as possible, thereby delaying or eliminating the separation of the laminar air stream from the club surface.

Reducing the drag of the club head not only at the point of impact, but also during the course of the entire downswing prior to the point of impact, would result in improved club head speed and increased distance of travel of the golf ball. When analyzing the swing of golfers, it has been noted that the heel/hosel region of the club head leads the swing during a significant portion of the downswing and that the ball striking face only leads the swing at (or immediately before) the point of impact with the golf ball. The phrase "leading the swing" is meant to describe that portion of the club head that faces the direction of swing trajectory. For purposes of discussion, the golf club and golf club head are considered to be at a 0° orientation when the ball striking face is leading the swing, i.e. at the point of impact. It has been noted that during a downswing, the golf club may be rotated by about 90° or more around the longitudinal axis of its shaft during the 90° of downswing prior to the point of impact with the golf ball.

During this final 90° portion of the downswing, the club head may be accelerated to approximately 65 miles per hour (mph) to over 100 mph, and in the case of some professional golfers, to as high as 140 mph. Further, as the speed of the club head increases, typically so does the drag acting on the club head. Thus, during this final 90° portion of the downswing, as the club head travels at speeds upwards of 100 mph, the drag force acting on the club head could significantly retard any further acceleration of the club head.

Club heads that have been designed to reduce the drag of the head at the point of impact, or from the point of view of the club face leading the swing, may not function well to reduce the drag during other phases of the swing cycle, such as when the heel/hosel region of the club head is leading the downswing.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide a golf club head with improved aerodynamic performance. In accordance with a first aspect, a golf club head includes one or more drag reducing structures on the body member. The drag-reduction structures are expected to reduce drag for the body member during a golf swing from an end of a backswing through a downswing.

In accordance with further aspects, a golf club includes a shaft and a club head. The club head includes a body member having a ball striking face, a heel, a toe, a back, a crown, a sole, and a hosel region located at the intersection of the ball striking face, the heel and the crown. The sole includes a channel extending from the hosel region toward the toe. An insert is received within the channel.

The club head may further include means for detachably securing the insert to the channel. Means for detachably securing may include threaded fasteners, snap fit mechanisms, sliding mechanisms, insertion mechanisms, detent mechanisms, tracks, rails, projections, notches, channels, adhesives and/or a combination thereof.

The insert may include projections, vanes, grooves, steps, recesses, surface finishes, etc.

According to other aspects, a golf club head system for a metal wood type club includes a club head having a body member with a ball striking face, a heel, a toe, a back, a crown, a sole, and a hosel region located at the intersection of the ball striking face, the heel and the crown. The sole includes a channel extending from the hosel region toward the toe. A first insert may be configured for being received within the channel. A second insert may be configured for being received within the channel. Means for detachably securing the first insert to the channel may be provided. Means for detachably securing the second insert to the channel may also be provided.

The club head may have a teardrop shaped body member. The angle of the narrow end of the teardrop may range from approximately 80 degrees to approximately 90 degrees.

According to even other aspects, a golf club head for a metal wood type club is provided. The club head may include a metal body member having a generally pear shape having a first round end and a second round end, when viewed from above, the second rounded end being more narrow than the first rounded end. The body member defines a ball striking face, a heel, a toe forming at least a portion of the second rounded end, a back forming at least a portion the second rounded end, a crown having a generally smooth convex surface, a sole, and a hosel region forming at least a portion of the first rounded end and located at the intersection of the ball striking face, the heel and the crown. The sole includes a channel extending from proximate the hosel region toward the toe. The channel defines a surface having one of a protrusion and a notch. A plastic injection-molded insert defines the other of the protrusion and the notch. The insert may be received within the channel, wherein the notch receives the protrusion to secure the insert to the channel.

These and additional features and advantages disclosed here will be further understood from the following detailed disclosure of certain embodiments.

Figure 1:
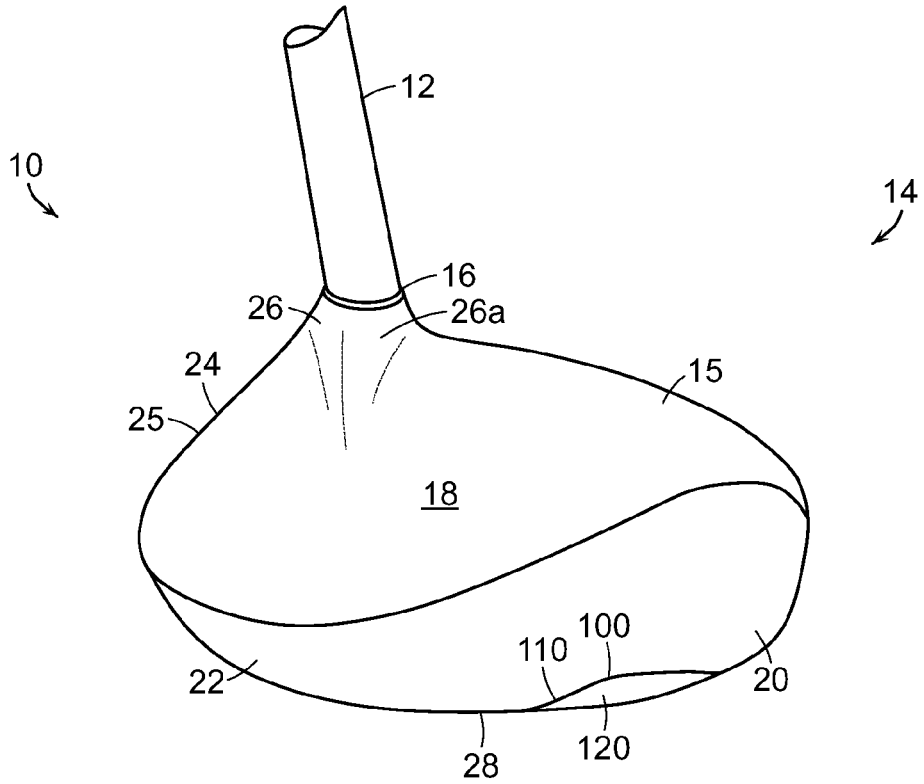
FIG. 1 is a partial perspective view of a golf club head attached to a golf club shaft according to illustrative aspects.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

According to several aspects, an illustrative embodiment of a golf club head 14 is shown in FIGS. 1-3B. The golf club head 14 may be attached to a shaft 12, as shown in FIG. 1, to form a golf club 10. The golf club head 14 may be a metal wood type club head, such as a driver, as shown. The shaft 12 of the golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors (including releasable and adjustable mechanisms), via friction fits, via retaining element structures, etc.). A grip or other handle element (not shown) may be positioned on the shaft 12 to provide a golfer with a slip resistant surface with which to grasp the golf club shaft 12.

In the example structure of FIGS. 1-3B, the club head 14 includes a body member 15 to which the shaft 12 is attached at a hosel or socket 16 configured for receiving the shaft 12 in known fashion. The body member 15 includes a plurality of portions, regions, or surfaces, such as a ball striking face 17, a crown 18, a toe 20, a back 22, a heel 24, a hosel region 26 and a sole 28.

Figure 4B:
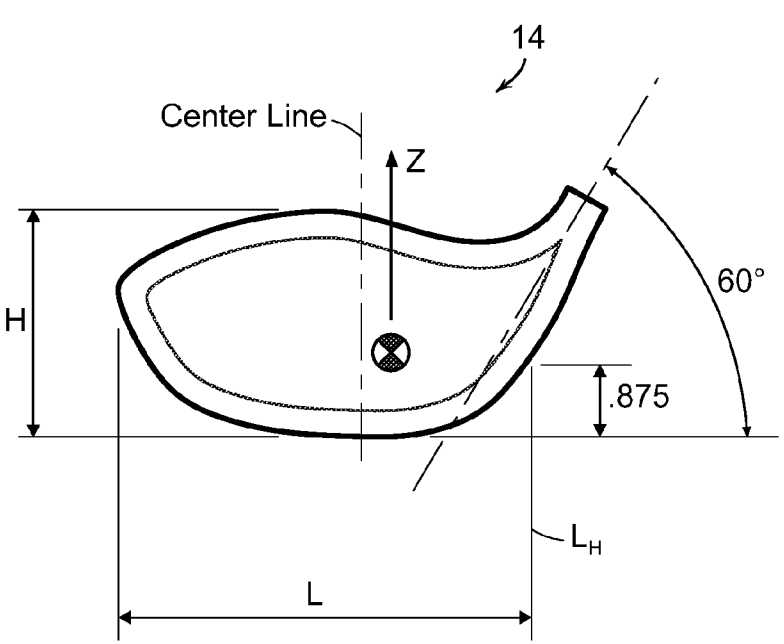
FIGS. 4A and 4B are schematic views of a club head (top plan view and front elevation view, respectively) illustrating certain club head parameters.
Figure 4A:
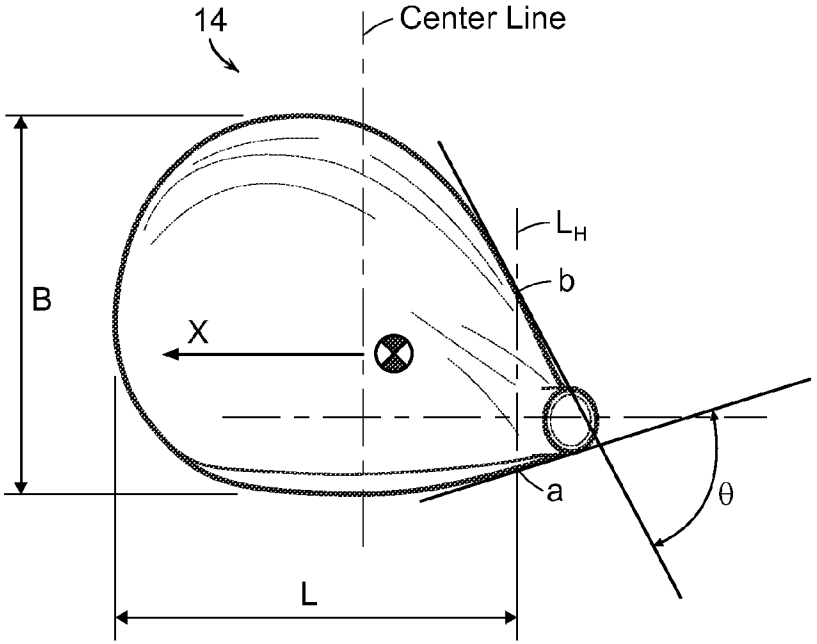

For purposes of this disclosure, and referring to FIGS. 4A and 4B, with a club head 14 positioned at a 60 degree lie angle as defined by the USGA (see USGA, "Procedure for Measuring the Club Head Size of Wood Clubs"), the "centerline" of the club head 14 may be considered to coincide with the indicator on the face squaring gauge when the face squaring gauge reads zero. The length (L) of the club head extends from the outermost point of the toe to the outermost point of the heel, as defined by the above-referenced USGA procedure. The breadth (B) of the club head extends from the outermost point of the face to the outmost point of the back. Similar to the procedure for determining the outermost point of the toe (but now turned 90 degrees), the outermost points of the face and back may be defined as the points of contact between the club head in the USGA 60 degree lie angle position with a vertical plate running parallel to the longitudinal axis of the shaft 12. The height (H) of the club head extends from the uppermost point of the crown to the lowermost point of the sole, as defined by the above-referenced USGA procedure. The terms "above," "below," "front," "rear," "heel-side" and "toe-side" all may refer to views associated with the club head 14 when it is positioned at this USGA 60 degree lie angle.

Referring back to FIGS. 1-3B, the crown 18, which is located on the upper side of the club head 14, extends from the ball striking face 17 back toward the back 22 of the golf club head 14. When the club head 14 is viewed from below, the crown 18 cannot be seen.

The sole 28, which is located on the lower or ground side of the club head 14 opposite to the crown 18, extends from the ball striking face 17 back toward the back 22. As with the crown 18, the sole 28 extends across the width of the club head 14, from the heel 24 to the toe 20. When the club head 14 is viewed from above, the sole 28 cannot be seen.

The back 22 is positioned opposite the ball striking face 17, is located between the crown 18 and the sole 28, and extends from the heel 24 to the toe 20. When the club head 14 is viewed from the front, the back 22 cannot be seen.

The heel 24 extends from the ball striking face 17 to the back 22. When the club head 14 is viewed from the toe-side, the heel 24 cannot be seen.

The toe 20 is shown as extending from the ball striking face 17 to the back 22 on the side of the club head 14 opposite to the heel 24. When the club head 14 is viewed from the heel-side, the toe 20 cannot be seen.

The socket 16 for attaching the shaft 12 to the club head 14 is located within the hosel region 26. The hosel region 26 is shown as being located at the intersection of the ball striking face 17, the heel 24 and the crown 18 and may encompass those portions of the heel 24 and the crown 18 that lie adjacent to the socket 16. Generally, the hosel region 26 includes surfaces that provide a transition from the socket 16 to the ball striking face 17, the heel 24 and/or the crown 18.

According to certain aspects, the club head 14 may include one or more drag-reducing structures in order to reduce the overall drag on the club head 14 during a user's golf swing from the end of a user's backswing through the downswing. The drag-reducing structures may be configured to provide reduced drag during the entire downswing of a user's golf swing or during a significant portion of the user's downswing, not just at the point of impact.

First, it may be noted, that the ball striking face 17 does not lead the swing over entire course of a player's downswing. Only at the point of impact with a golf ball is the ball striking face 17 ideally leading the swing, i.e., the ball striking face 17 is ideally substantially perpendicular to the direction of travel of club head 14 (and the flight of the golf ball) at the point of impact. However, it is known that during the player's backswing and during the player's downswing, the player's hand twist golf club 10 such that yaw is introduced, thereby pivoting ball striking face 17 away from its position at impact. With the orientation of ball striking face 17 at the point of impact considered to be 0°, during the backswing ball striking face twists away from the user toward toe 20 and back 22 to a maximum of 90° (or more) of yaw, at which point heel 24 is the leading edge of club head 14.

Second, it may be noted, that aerodynamic boundary layer phenomena acting over the course of the player's downswing may cause a reduction in club speed due to drag. During a player's downswing, the air pressure and the energy in the boundary layer flowing over the surface of the club head tend to increase as the air travels over the length of the club head. The greater the air pressure and energy in the boundary layer, the more likely the boundary layer will separate from the club head 14, thereby creating a low pressure separation zone behind the club head. The larger the separation zone, the greater the drag. Thus, according to certain aspects, drag-reducing structures may be designed to reduce the air pressure and the energy in the boundary layer, thereby allowing the boundary layer to maintain contact with the surface of the club head over a longer distance and thereby reducing the size of the separation zone. Further, according to certain aspects, the drag-reducing structures may be designed to maintain laminar flow over the surface of the club head over the greatest distance possible. A laminar flow results in less drag due to friction over the surface of the club head, and thus, maintaining a laminar air flow over the entire surface of the club head may be the most desirable. However, this is generally not possible. Thus, alternatively, when a laminar flow cannot be completely maintained over the entire surface of the club head 14, it may be desirable in some instances to trigger a transition from a laminar flow to a turbulent flow. Although a turbulent flow has a higher drag over the surface, as compared to a laminar flow, the turbulent boundary layer flow will resist separating from the surface at higher pressures and energy than the laminar flow. By delaying the separation of the (now turbulent) boundary layer flow, from the surface of the club head, the size of the separation zone in the trailing region is reduce and correspondingly drag due to the low-pressure trailing region is reduced.

In general, it is expected that minimizing the size of the separation zone behind the club head 14, i.e., maintaining a boundary layer airflow (whether laminar or turbulent) for as long as possible, should result in the least drag. Further, it is expected that maintaining a boundary layer over the club head as the club head changes orientation during the player's downswing should also result in increase club head speed. Thus, some of the example drag-reducing structures described in more detail below may be provided to delay separation of the boundary layer airflow from one or more of the surfaces of the club head 14 when the ball striking face 17 is generally leading the swing, i.e., when air flows over the club head 14 from the ball striking face 17 toward the back 22. Additionally, it is expected that some of the example drag-reducing structures described in more detail below may provide various means to delay separation of the boundary layer airflow from one or more surfaces of the club head 14 when the heel 24 is generally leading the swing, i.e., when air flows over the club head 14 from the heel 24 toward the toe 20. Moreover, it is expected that some of the example drag-reducing structures described in more detail below may provide various means to delay separation of the boundary layer airflow from one or more surfaces of the club head 14 when the hosel region 26 is generally leading the swing, i.e., when air flows over the club head 14 from the hosel region 26 toward the toe 20 and/or the back 22. Further, it is even expected that, in some situations, some of the example drag-reducing structures described in more detail below may provide various means to trigger the transition from a laminar airflow to a turbulent air flow over one or more of the surfaces of the club head 14, such that the boundary layer may be expected to remain attached to the surface of the club head for a longer distance. The example drag-reducing structures disclosed herein may be incorporated singly or in combination in club head 14 and are applicable to any and all embodiments of the club head 14.

Thus, according to some aspects and as illustrated in the embodiment of FIGS. 1-3B, the body member 15 may have a relatively featureless, smoothly curved convex crown 18. A shallow hosel fairing 26*a* may be provided to assist in aligning the air flowing around the hosel region 26 and the shaft 12 in order to maintain a smoothly flow over the surface of the crown 18. Further, the heel 24 may be provided with an airfoil-like surface 25, i.e., a smooth surface having a quasi-parabolic vertical cross-section that smoothly merges with the crown 18 and/or the sole 28. U.S. patent application Ser. No. 12/779,669, filed May 13, 2010, entitled "Golf Club Assembly and Golf Club With Aerodynamic Features," and naming Gary Tavares, et al. as inventors, is incorporated by reference in its entirety herein.

Figure 2:
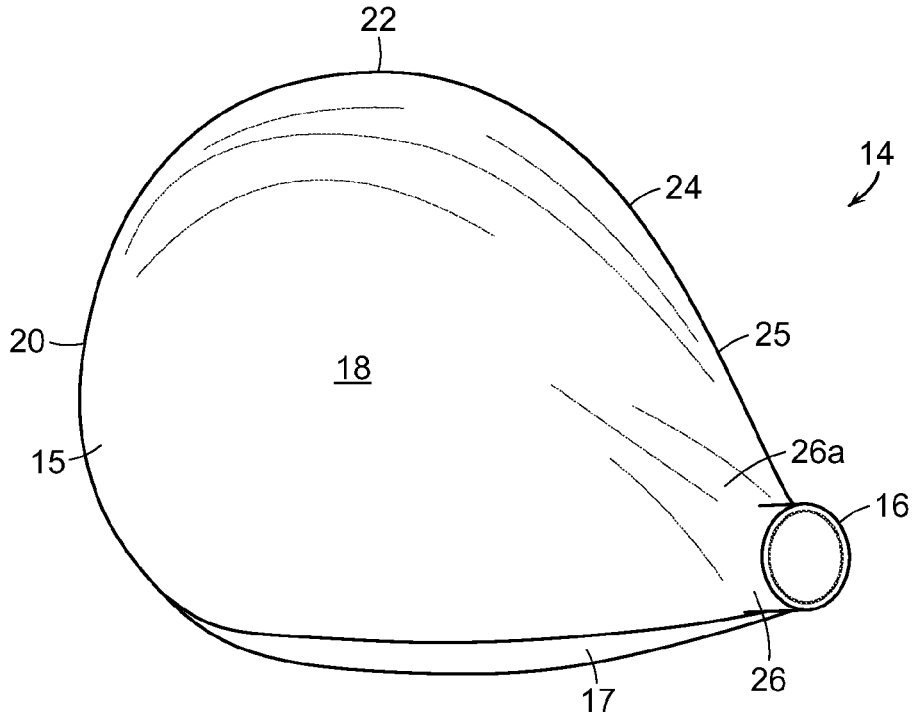
FIG. 2 is a top plan view of the club head of FIG. 1.

Further, according to certain aspects and as illustrated in the embodiment of FIGS. 2 and 4A, the body member 15 may have a generally pear shape or a generally teardrop shape when viewed from above. Generally, such a shape has a wide, rounded, end and a narrow, more pointed, opposing end. When viewing body member 15 from above, the narrow, more pointed end is associated with the hosel region 26 and the wide, more rounded end is associated with the toe 20, the back 22 and the intersection of the toe 20 with the back 22. Further, generally, such a shape includes two legs that connect the wide, rounded, end with the narrow, more pointed, opposing end. When viewing the body member from above, a first leg extends between the hosel region 26 and the toe 20 and may generally be associated with the ball striking face 17. The second leg extends between the hosel region 26 and the back 22 and may generally be associated with the heel 24. The legs of the pear or teardrop shape may appear slightly convex, substantially straight or slightly concave, when the club head is viewed from above. In this context, the term "rounded" refers to a gradually curved convex shape. The convex curvature may include constant curvature and/or non-constant curvature. Further, a pear or teardrop shape need not be completely symmetrical. Thus, for example, the curvature of the wide, rounded, end may be flatter on one side and more curved on the other side. As another example, one of the legs of the pear shape or the teardrop shape may be slightly convex and the other may be relatively straight. Referring to FIG. 4A, an angle θ may be defined between tangents drawn where the club head length lead-line ($L_H$) defining the outermost point of the heel (as defined by the above-referenced USGA procedure) intersects the profile of the ball striking face 17 at (a) and intersects the profile of the heel 24 at (b), as viewed from above. This angle θ provides an indication of the narrowness of the pear or the teardrop shape.

In the embodiment of FIGS. 1-3B, and as best seen in FIG. 2, the hosel region 26 defines the narrow, more pointed, end, i.e., the tip, of a teardrop shape. This hosel region 26 has a rounded profile, when viewed from above, and thus the tip of the teardrop shape is not sharply pointed. The profile of the toe 20, the back 22 and the intersection therebetween, when viewed from above, define the wide, rounded, end of the teardrop shape. The profile of the ball striking face 17 defines the first leg of the teardrop shape. This leg may be slightly convex, i.e. slightly bulged. The profile of the heel 24, when viewed from above, defines the second leg of the teardrop shape. This leg may be substantially straight or very slightly convex. Further, for this embodiment, the angle θ may range from approximately 65 degrees to approximately 105 degrees, with a more preferred range from approximately 75 degrees to approximately 95 degrees, and a further preferred range from approximately 80 degrees to approximately 90 degrees.

According to certain aspects of the present disclosure, the body member 15 may be generally "flattened" compared to other club heads having similar volumes. In other words, the height (H) of the club head may be less than the height of clubs having similar volumes and profiles. Thus, a driver having a volume ranging from 400 cc to 470 cc may have a ratio of the club head height-to-volume that ranges from 0.110 to 0.120. By way of non-limiting example, a club head having a volume of 445 cc may have a club height of 53 mm, thereby presenting a club head height-to-volume ratio of 0.119. As another example, for smaller clubs, a driver having a volume of 400 cc may have a club height of only 46 mm, thereby presenting a club head height-to-volume ratio of 0.115.

Alternatively, the "flattening" of the club head may be expressed as a ratio of the club head's height (H) to the club head's length (L). Thus, a driver having a volume ranging from 420 cc to 470 cc may have a ratio of the club head height-to-length that ranges from 0.44 to 0.50. By way of non-limiting example, for a club head having a volume of 445 cc, the club length (L) may be 117 mm and the club height (H) may be 53 mm or less, thereby presenting a club head height-to-length ratio of 0.453.

According to aspects of the present disclosure, the body member 15 may be generally "elongated" compared to other club heads having similar volumes. In other words, the breadth (B) of the club head may be greater than the breadth of clubs having similar volumes and profiles. Thus, a driver having a volume ranging from 420 cc to 470 cc may have a ratio of the club head breadth-to-volume that ranges from 0.260 to 0.275. By way of a non-limiting example, a club head having a volume of 445 cc may have a club breadth of 119 mm, thereby presenting a club head breadth-to-volume ratio of 0.267.

Alternatively, the "elongation" of the club head may be expressed as a ratio of the club head's breadth (B) to the club head's length (L). Thus, a driver having a volume ranging from 420 cc to 470 cc may have a ratio of the club head breadth-to-length that ranges from 0.97 to 1.02. By way of a non-limiting example, for a club head having a volume of 445 cc, the club breadth (B) may be 118 mm and the club length (L) may be 119 mm, thereby presenting a club head breadth-to-length ratio of 0.99.

It is expected that the teardrop shape of the club head, relative to more traditionally shaped club heads having the same volume, will allow for a more streamlined club head with improved moment-of-inertia (MOI) characteristics. Thus, for example, it is expected that the moment-of-inertia (Izz) around a vertical axis associated with the club head's center-of-gravity may be greater than 3100 g-cm$^2$, greater than 3200 g-cm$^2$, or even greater than 3300 g-cm$^2$. Further, it is expected that the moment-of-inertia (Ixx) around a horizontal axis associated with the club head's center-of-gravity may be greater than 5250 g-cm$^2$, greater than 5350 g-cm$^2$, or even greater than 5450 g-cm$^2$. The vertical (z) axis and the horizontal (x) axis are defined with the club head in the 60° lie angle position (see FIGS. 4A and 4B).

Figure 3A:
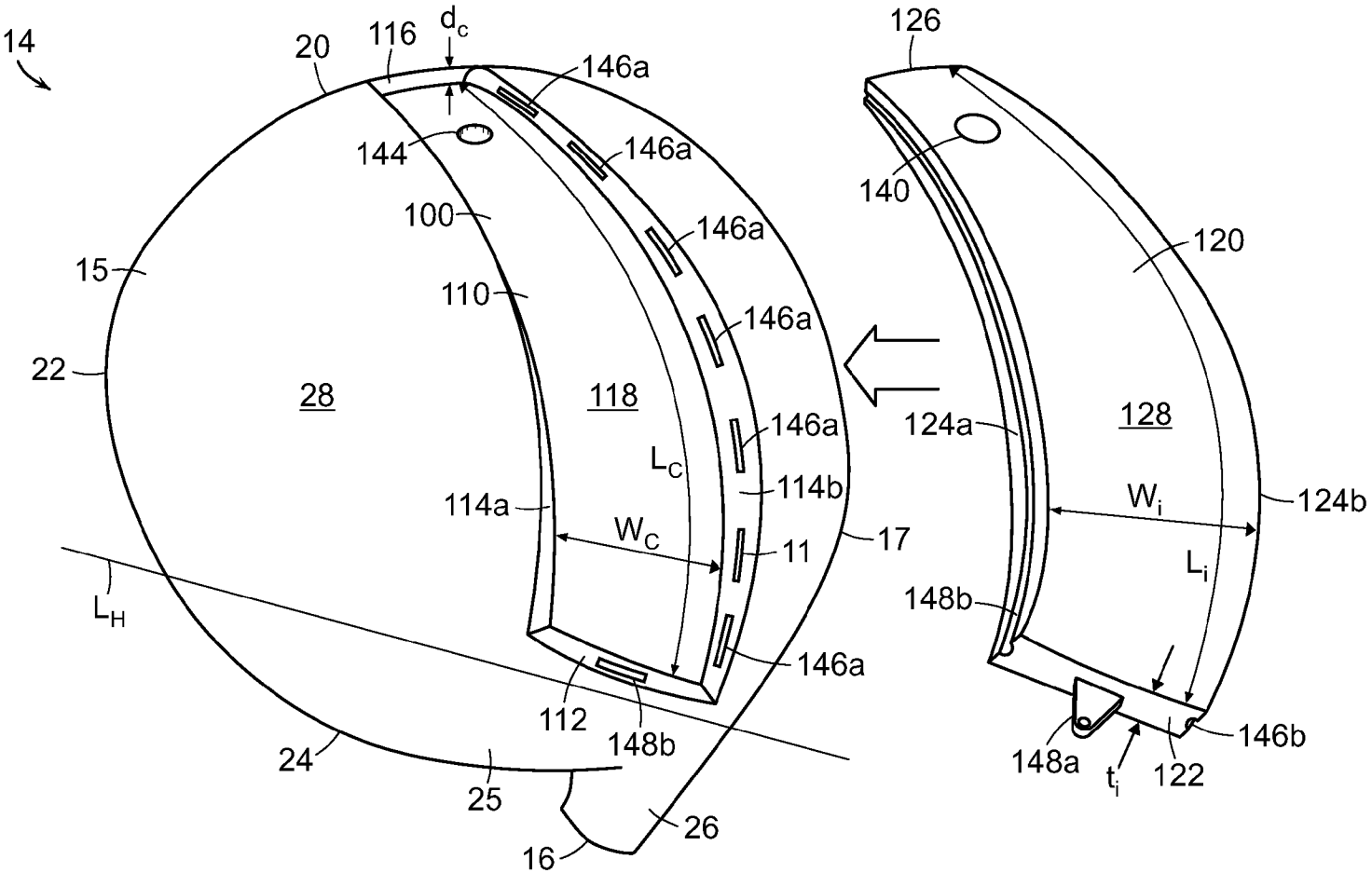
FIG. 3A is an exploded perspective view of the club head of FIG. 1 with a channel and with an insert configured for being received within the channel, according to certain aspects.
Figure 3B:
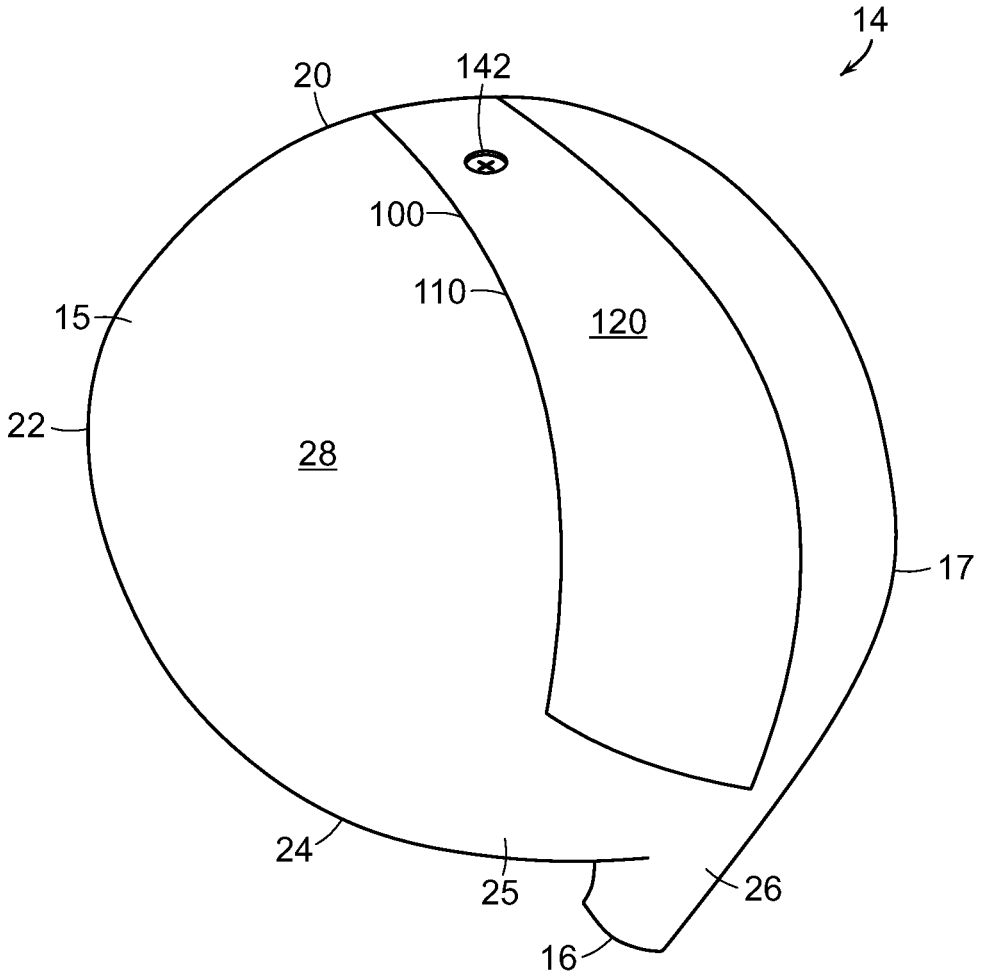
FIG. 3B is a perspective view of the club head of FIG. 1, with the insert received within the channel.

According to some aspects and referring to the embodiment of FIGS. 1-3B, and particularly to FIGS. 3A and 3B, a drag-reducing structure 100 may be provided on a body member 15. According to certain aspects, the drag-reducing structure 100 may be formed as a relatively wide, shallow groove or channel 110 in the sole 28. The channel 110 may generally extend from the hosel region 26 toward the toe 20. Further, the channel 110 may extend to the toe (see FIG. 1) and/or even into the toe 20. The depth $d_c$ of the channel may be constant or it may vary, for example, by increasing (or decreasing) in depth as it extends away from the hosel region 26. The width $w_c$ of the channel 110 may be constant or it may vary, for example, by decreasing (on increasing) as it extends away from the hosel region 26. The width or depth of the channel 110 may increase and/or decrease smoothly and gradually or stepwise. The length of the channel 110 may be two to three times (or even greater) the width of the channel, such that the channel 110 may be considered to be elongated. The channel 110 may be formed in the sole 28 in any conventional fashion as would be known to ordinary persons of skill in the art. For example, the channel 110 may be integrally formed with the club head (or portions of the club head) when the club head (or portions of the club head) are cast or may be machined or otherwise subsequently formed in the sole 28.

According to certain other aspects, the channel 110 extends across the centerline of the club head 14. Further, according to even other aspects, the channel 110 may generally extend from the hosel region 26 toward the intersection of the toe 20 with the back 22.

Referring to FIGS. 3A and 3B, in this example embodiment, the channel 110 may generally be located in a forward region of the club head 14. When the club head is viewed from the heel-side, it can be seen that the forward region of the club head, by virtue of its larger cross-sectional area, will displace more air than a rear region of the club head. Thus, it is expected that the pressure build-up of the air flowing over the sole 28 in the forward region will be greater than the pressure build-up of the air flowing over the sole 28 in the rear region of the club head. Thus, by placing the channel 110 in the forward region of the club head 14, the channel 110 may have a greater effect on the aerodynamic behavior of the club head.

The forward region of the club head 14 may be considered to be the forward 20% of the breadth (B) of the club head, the forward 30% of the breadth (B) of the club head, the forward 40% of the breadth (B) of the club head, or even the forward 50% of the breadth (B) of the club head 14.

Further, in the illustrated embodiments of FIGS. 1-3B, the channel 110 is shown as being substantially trapezoidally-shaped, having a hosel-side edge 112, sidewalls 114*a*, 114*b*, a toe-side edge 116, and a floor 118. Referring to FIG. 3A, the hosel-side edge 112 may be located close to the club head's length lead-line ($L_H$), i.e., the lead-line defining the outermost point of the heel (as defined by the above-referenced USGA procedure). Further, the hosel-side edge 112 of the channel 110 in this embodiment is shown as generally extending in a front-to-rear direction. In general, the hosel-side edge 112 of the channel 110 need not located near the lead-line ($L_H$), but may be located more toward the center of the club head 14. Thus, in general, the hosel-side edge 112 of the channel 110 may be located within approximately 0% to 35% of the length (L) of the club head from the lead-line $L_H$. Thus, for example, the hosel-side edge 112 of the channel 110 may be located within approximately 15%, within approximately 10%, or even within approximately 5% of the length (L) of the club head from the lead-line $L_H$. Even further, in the particular embodiment of FIGS. 1-3B, the hosel-side edge 112 is formed as a relatively straight edge. In general, the hosel-side edge 112 of the channel 110 need not be formed as a relative straight edge. Thus, by way of non-limiting examples, the hosel-side edge 112 may be concavely curved, convexly curved, S-shaped, chevron-shaped, etc.

As shown in the embodiment of FIGS. 1-3B, the toe-side edge 116 of the channel 110 may be located approximately at the transition of the sole 28 to the toe 20. In general, the channel 110 need not extend all the way to the toe 20. Thus, the toe-side edge 116 of the channel 110 may be located more toward the center of the club head 14. Alternatively, the toe-side edge 116 may be located in the toe 20. Thus, in general, the toe-side edge 116 of the channel 110 may be located within approximately 65% to 100% of the length (L) of the club head from the lead-line $L_H$. Thus, for example, the toe-side edge 116 of the channel 110 may be located beyond approximately 75%, beyond approximately 80%, or even beyond approximately 85% of the length (L) of the club head from the lead-line $L_H$.

The first and second sidewalls 114*a*, 114*b* are shown in FIG. 3A as extending, with a slight curvature, from the hosel-side edge 112 of the channel 110 toward the toe-side edge 116 of the channel 110. Further, in this particular embodiment, as the sidewalls 114*a*, 114*b* extend toward the toe 20 they angle slightly toward one another, such that the width of the channel 110 decreases. Thus, the channel 110 may be provided with a cross-sectional area ($A_R$) that generally decreases as the channel 110 extends toward the toe 20. In certain embodiments, the sidewalls 114*a*, 114*b* may angle slightly toward one another as they extend toward the toe 20, such that the width of the channel 110 and the cross-sectional area increase. Optionally, the sidewalls 114*a*, 114*b* may run parallel to one another as they extend toward the toe 20, such that the width of the channel 110 and the cross-sectional area remain constant.

The channel 110 may have a maximum depth $d_c$ that ranges from approximately 2 mm to approximately 10 mm. Thus, for example, the channel 110 may be a relatively shallow recess, having a maximum depth $d_c$ of less than or equal to 6 mm, to 4 mm, or even less than or equal to 3 mm. Additionally, the channel 110 may have a maximum width $w_c$ that ranges from approximately 20 mm to approximately 60 mm. Thus, for example, the channel 110 may be relatively narrow, having a maximum width $w_c$ of less than or equal to 40 mm, to 30 mm, or even less than or equal to 25 mm. Further, the channel 110 may have a maximum length $l_c$ that ranges from approximately 70 mm to approximately 140 mm. Thus, for example, the channel 110 may have a maximum length $l_c$ of greater than or equal to 80 mm, to 100 mm, or even greater than or equal to 120 mm. According to certain aspects, the channel 110 may have a maximum length-to-maximum width ratio of 0.10 to 0.50.

An insert 120 may be configured for placement within the channel 110. In the embodiment of FIGS. 1-3B, the insert 120 is shown as being substantially trapezoidally-shaped, having a hosel-side edge 122, sidewalls 124*a*, 124*b*, a toe-side edge 126, and a top, outer, exposed surface 128. The insert 120 may have a shape and size that are completely or partially complementary with the shape of the channel 110. In other words, the length $l_i$ of the insert 120 may equal the length $l_c$ of the channel 110; the width $w_i$ of the insert 120 may equal the width $w_c$ of the channel 110; and the thickness $t_i$ of the insert 120 may equal the depth $d_c$ of the channel 110.

Figure 5:
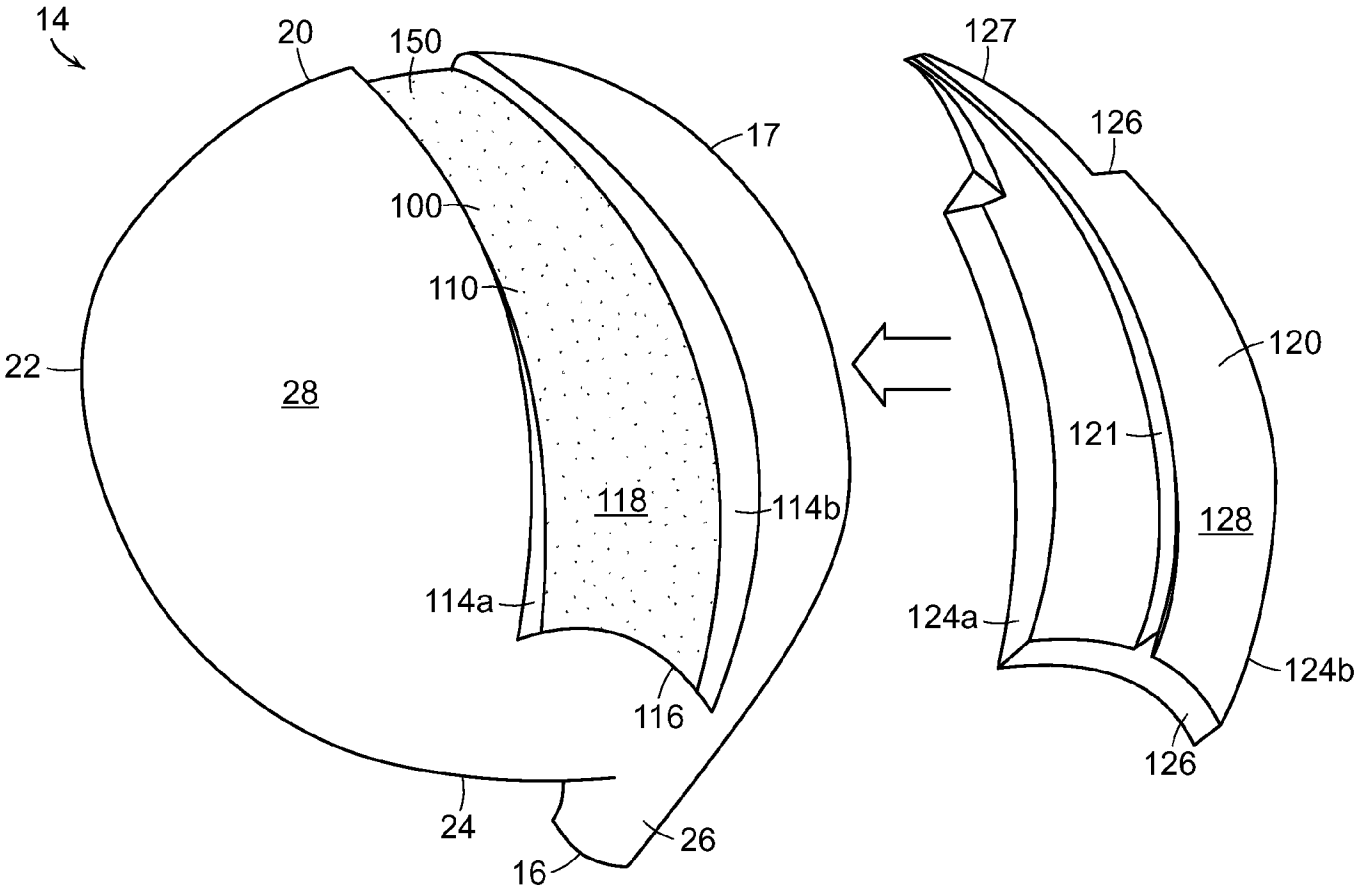
FIG. 5 is an exploded perspective view of another club head with a channel and with an insert configured for being received within the channel, according to certain illustrative aspects.

Alternatively, the insert 120 may have a footprint (based on the insert's length and width dimensions and shape) that differs from the footprint of the channel 110 (based on the channel's length and width dimensions and shape). For example, the insert 120 may extend across the entire width $w_c$ of the channel 110, but may extend only partway along the length $l_c$ of the channel 110. As shown in FIG. 5, the insert 120 may have a profiled toe-side edge 126, while the channel 110 does not. For example, the toe-side edge 126 may include one or more extensions 127. Optionally, the extension 127 may gradually narrow as it extends toward its free end. Further, optionally, the extension 127 may gradually get thinner as it extends toward its free end.

Figure 6:
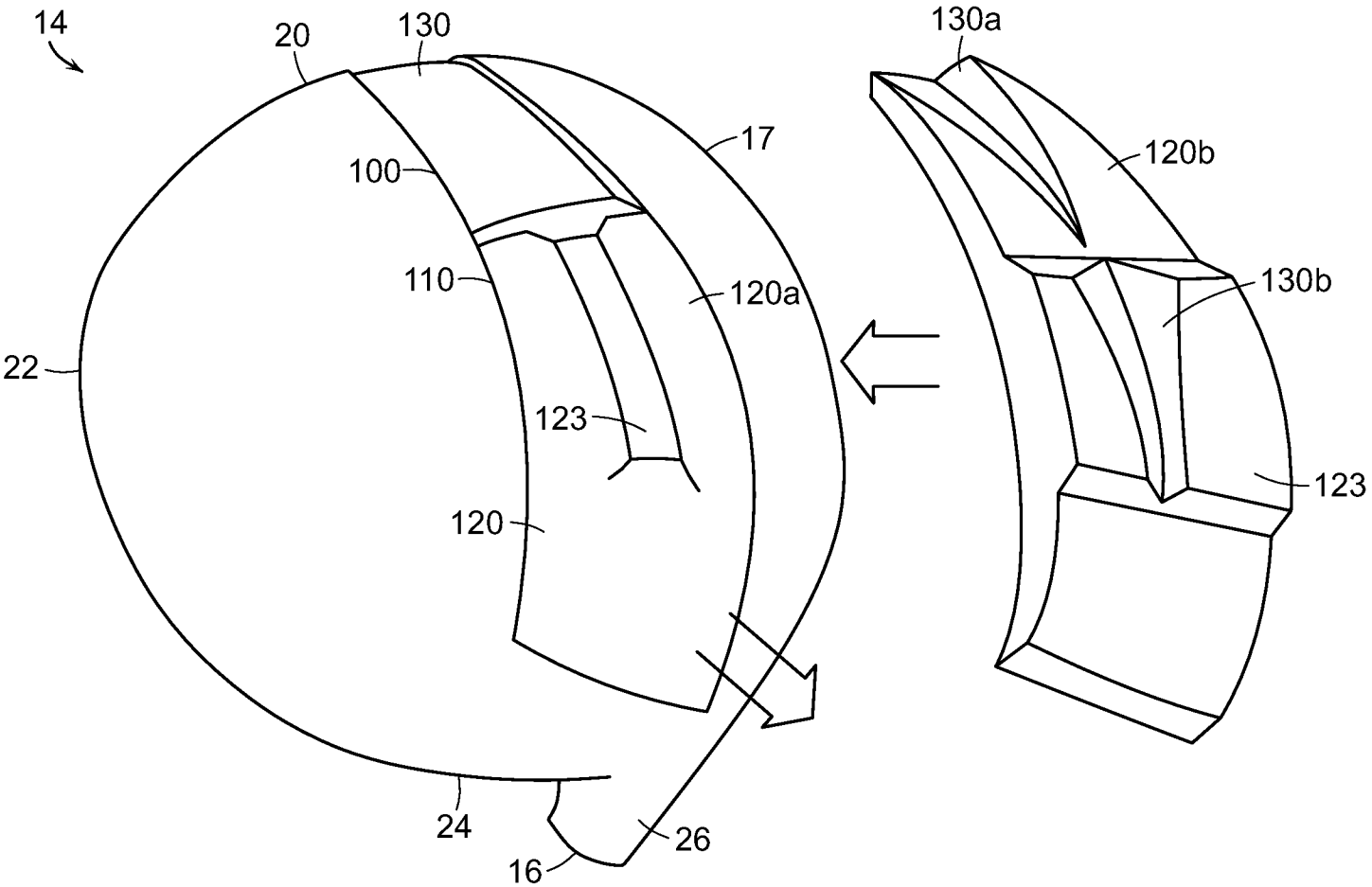
FIG. 6 is an exploded perspective view of another club head with an insert received within the channel and with another insert configured for being received within the channel, according to other illustrative aspects.

According to one embodiment, the insert 120 may have the same footprint as the channel 110, but it may have an insert thickness $t_i$ that is less that the depth $d_c$ of the channel 110. Thus, by way of non-limiting example and referring to FIG. 6, at least a portion of the insert 120 may lie below the surface of the sole 28. In this manner, a recess 130 may be formed in the sole 28. Alternatively, the insert 120 may have an insert thickness $t_i$ that is greater that the depth $d_c$ of the channel 110. Thus, by way of non-limiting example, at least a portion of the insert 120 may lie above the surface of the sole 28. In this manner, a step 123 or rise may be formed in the insert 120 and also in the sole 28. According to another embodiment (not shown), the insert 120 may completely fill the portion of the channel 110 that is closest to the hosel region 26, but then have a thickness $t_i$ that gradually decreases as the channel 110 extends away from the hosel region. Thus, as a non-limiting example, the insert 120 and the channel 110 may cooperate to form a recess 130 that gradually increases in cross-sectional area as it extends away from the hosel region 26 and toward the toe 20.

As air flows over the sole 28 of the club head 14 generally from the heel 24 to the toe 20, the pressure and energy in the boundary layer airflow increases. The recess 130 may function as a diffuser, such that the pressure of the air flowing over the sole 28 of the club head 14 from the heel 24 toward the toe 20 may be decreased. In other words, it is expected that such a diffusing action may assist in reducing the pressure and the energy of the air flowing over the surface and thereby assist in maintaining a boundary layer airflow over a greater distance, i.e., delay the separation of the boundary layer airflow from the surface of the club head. In general, recess 130 may take any of various shapes. For example, it may be desirable to provide a recess 130 that is elongated in the heel-to-toe direction of the club head and that extends along a majority of the length $l_c$ of the channel 110, such that the recess 130 guides the air flow, thus reducing drag.

Figure 7:
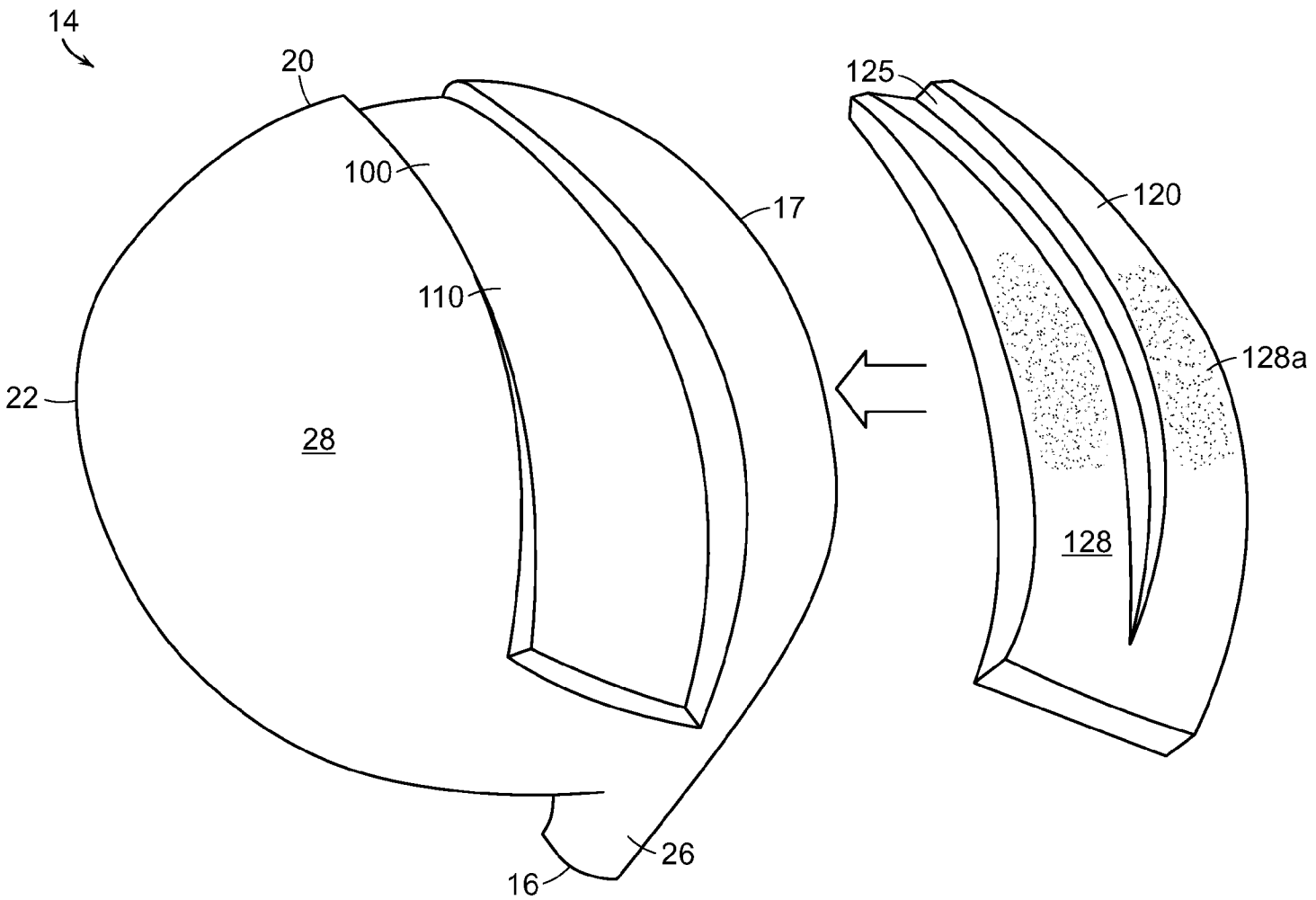
FIG. 7 is an exploded perspective view of another club head with a channel and with an insert configured for being received within the channel, according to some illustrative aspects.

Optionally, the insert 120 may include additional features. For example, referring back to FIG. 5, the insert 120 may include one or more vanes 121 that extend upward from the top surface 128 of the insert 120. As shown in FIG. 7, the insert 120 may include one or more grooves 125. Also as shown in FIG. 7, the insert 120 may include areas of surface texture 128*a* on its top surface 128. For example, portions of the surface 128 of the insert 120 may have a smooth texture (i.e., an average roughness Ra ranging from approximately 0.012 μm to approximately 0.90 μm), while other portions of the surface 128 of the insert 120 may have a relatively rough texture (i.e., an average roughness Ra ranging from approximately 1.00 μm to approximately 12.5 μm).

According to some aspects, insert 120 may be formed of a plastic, for example, injection molded plastic, compression molded plastic, machined sheet or plate plastic, thermoplastics or thermosets. Other materials, such as metals, ceramics, composites, etc. or combinations thereof, may be used to form insert 120. By way of non-limiting example, insert 120 may be formed as a metal core with an overmolded plastic layer.

The insert 120 may be detachably secured within the channel 110. This offers the club head designer greater flexibility when shaping the surfaces of sole 28 and incorporating any of various aerodynamic features. Means for detachably securing may include mechanical fasteners such as screws, snap fit features, track features, or a combination thereof. In general, means for detachably securing the insert 120 within the channel 110 may include elastically-deformable snap fit mechanisms, sliding mechanisms, insertion mechanisms (such as press-fit or friction-fit mechanisms), detent and/or spring-loaded mechanisms, latching mechanisms, and/or a combination thereof.

Thus, referring to back to FIGS. 3A and 3B, as one example, the insert 120 may have one or more through holes 140 for receiving a threaded fastener 142 (see FIG. 3B) and the channel 110 may have complementary threaded holes 144 for receiving the threaded fasteners. Further referring to FIG. 3A, as another example, the channel 110 and the insert 120 may have a set of complementary tracks 146*a* or protrusions 146*a* and channels 146*b* or notches 146*b* that would allow the insert 120 to be slid into the channel 110 from the toe 20 toward the hosel region 26, or vice versa, from the hosel region 26 toward the toe 20. As shown in FIG. 3A, the protrusions 146*a* may take the form of a plurality of protrusions 146*a* spaced along the sidewalls 114*a*, 114*b*. The protrusion 146*a* could also be a single continuous protrusion or track 146*a* extending along the sidewalls 114*a*, 114*b*. Likewise, the notches 146*b* could be a corresponding plurality of notches 146*b* or a continuous notch or channel 146*b*. In such configuration, the protrusions 146*a* are received in the notches 146*b* to attach the insert 120 to the club head 14. It is further understood that the protrusions 146*a* and notches 146*b* could be reversed wherein protrusions 146*b* are located on the insert 120 and notches 146*b* are located on the club head 14. Still referring to FIG. 3A, as even another example, one of the channel 110 or the insert 120 may have one or more snap fit projections 148*a* that complementarily mate with one or more snap fit receptacles 148*b* located on the other of the channel 110 and the insert 120. In certain embodiments, the insert 120, itself, may have a sufficient degree of flexibility or elasticity such that it can be overall slightly deformed to allow for insertion into and retention by the channel 110. As such, in one example, the protrusion 146*a* or notch 146*b* can have a degree of resilient deformation or resilient deflection when the insert 120 is being inserted into the channel 110 wherein the protrusions 146*a* can be received in the notches 146*b*. It is further understood that the insert 120 can be detachably secured in the channel 110 via an interference fit, a press fit and/or a frictional fit configuration wherein respective peripheral walls of the channel 110 and insert 120 are in tight surface-to-surface engagement.

Other means for detachably securing the insert 120 within the channel 110 may include adhesives 150 (see FIG. 5). For example, adhesives that liquefy or at least soften at high temperatures may be used to retain the insert 120 within the channel 110. The phrase "high temperatures" refers to temperatures higher than would be expected to be experienced by the club head during play or during storage. Thus, for example, adhesive softening temperatures above 80° C. may be considered high, with adhesive softening temperatures above 100° C. providing assurance that an adhesive that liquefies or softens at or above 100° C. will not accidently release the insert 120 from the channel 110 due to normal playing or storing conditions.

According to another aspect, the insert 120 may be permanently received by and secured within channel 110.

According to certain aspects, a plurality of inserts 120 may be configured for interchangeable receipt by a channel 110. Referring back to FIG. 6, a club head 14 having a channel 110 is shown with a first insert 120*a* and a second insert 120*b*, each adapted for insertion into the channel 110. First insert 120*a* is shown detachably secured within channel 110. Upon removal of first insert 120*a* from the channel, second insert 120*b* may be detachably secured within channel 110. Optionally, second insert 120*b* may be permanently secured within channel 110. Second insert 120*b* is shown with a first recess 130*a* and a second recess 130*b*. Second insert 120*b* is also shown with a step 123 that extends across the entire width of the channel 110.

Providing a choice of multiple interchangeable inserts 120*a*, 120*b*, allows a player to customize the golf club. The various inserts 120 may have different configurations as discussed above, different surface finishes and/or textures, different materials, different weight distributions, different colors, etc. If the inserts 120*a*, 120*b* are detachably received by the channel 110, then a player may easily remove a first insert 120*a* from the channel and replace it with a second insert 120*b*.

Figure 8:
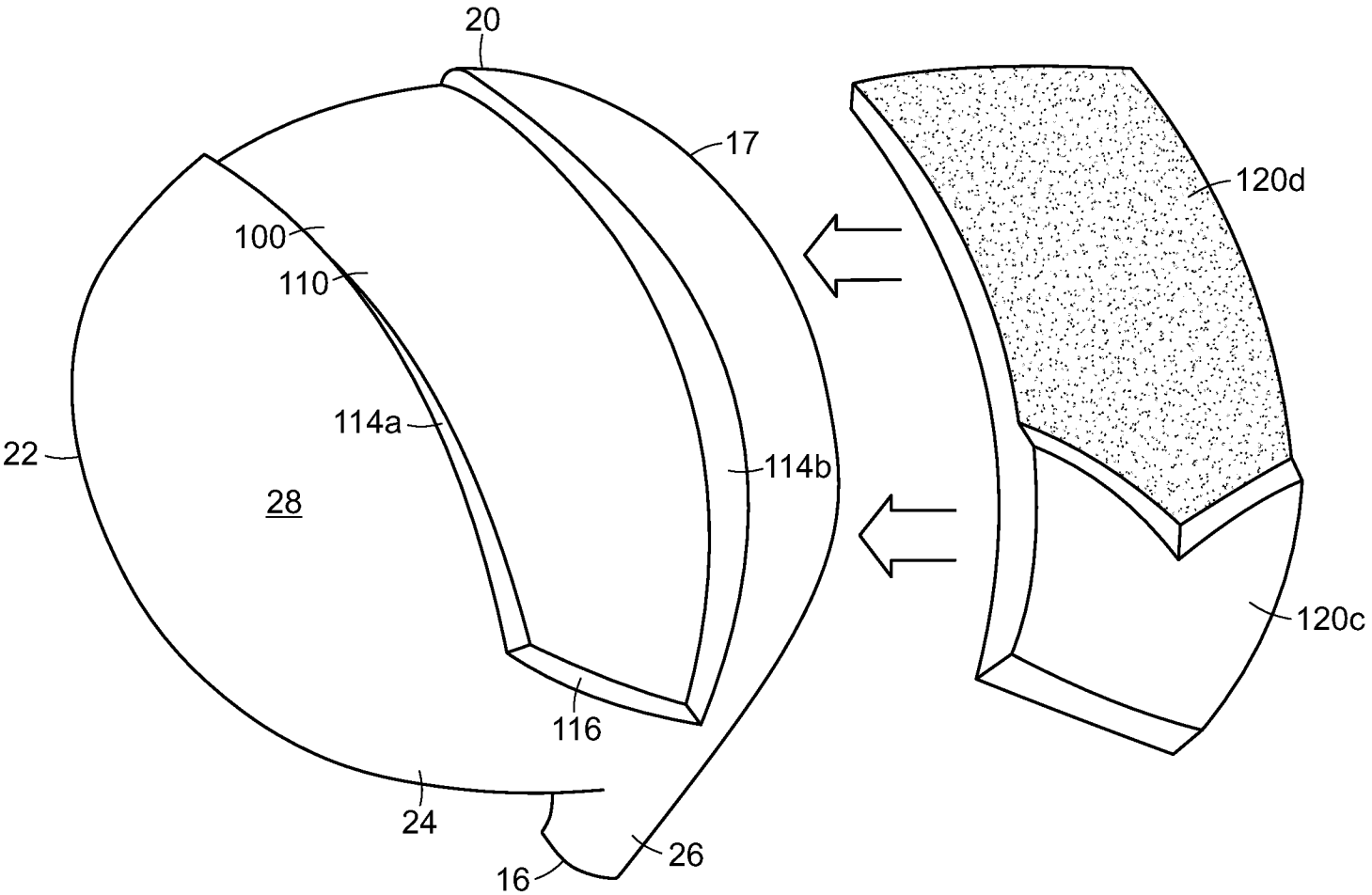
FIG. 8 is an exploded perspective view of another club head with a channel and with two insert configured for being received within the channel, according to certain illustrative aspects.

According to even other aspects, a plurality of inserts 120 may be concurrently received by the channel 110. FIG. 8 illustrates a channel 110, wherein sidewall 114*a* is oriented more towards the intersection of the toe 20 and the back 22 than is the sidewall 114*a* as illustrated in FIGS. 3A and 3B. Further, FIG. 8 shows two separate inserts: heel-side insert 120*c* and toe-side insert 120*d*. Heel-side insert 120*c* is shown with a smooth surface texture and a sloped chevron-shaped surface where it meets toe-side insert 120*d*. Toe-side insert 120*d* is shown with a rough surface texture. Further, in this particular embodiment, the thickness of insert 120*c* is greater than the thickness of insert 120*d*. both placed within channel 110. In a first example configuration (not shown), the heel-side insert 120*c* may be the only insert detachably secured within channel 110. In a second example configuration (not shown), the toe-side insert 120*d* may be the only insert detachably secured within channel 110. In a third example configuration, both the heel-side insert 120*c* and the toe-side insert 120*d* may be secured within channel 110. This ability to place one or more of a plurality of inserts 120 into a single channel 110 allows even greater customization of the club head.

Figure 9:
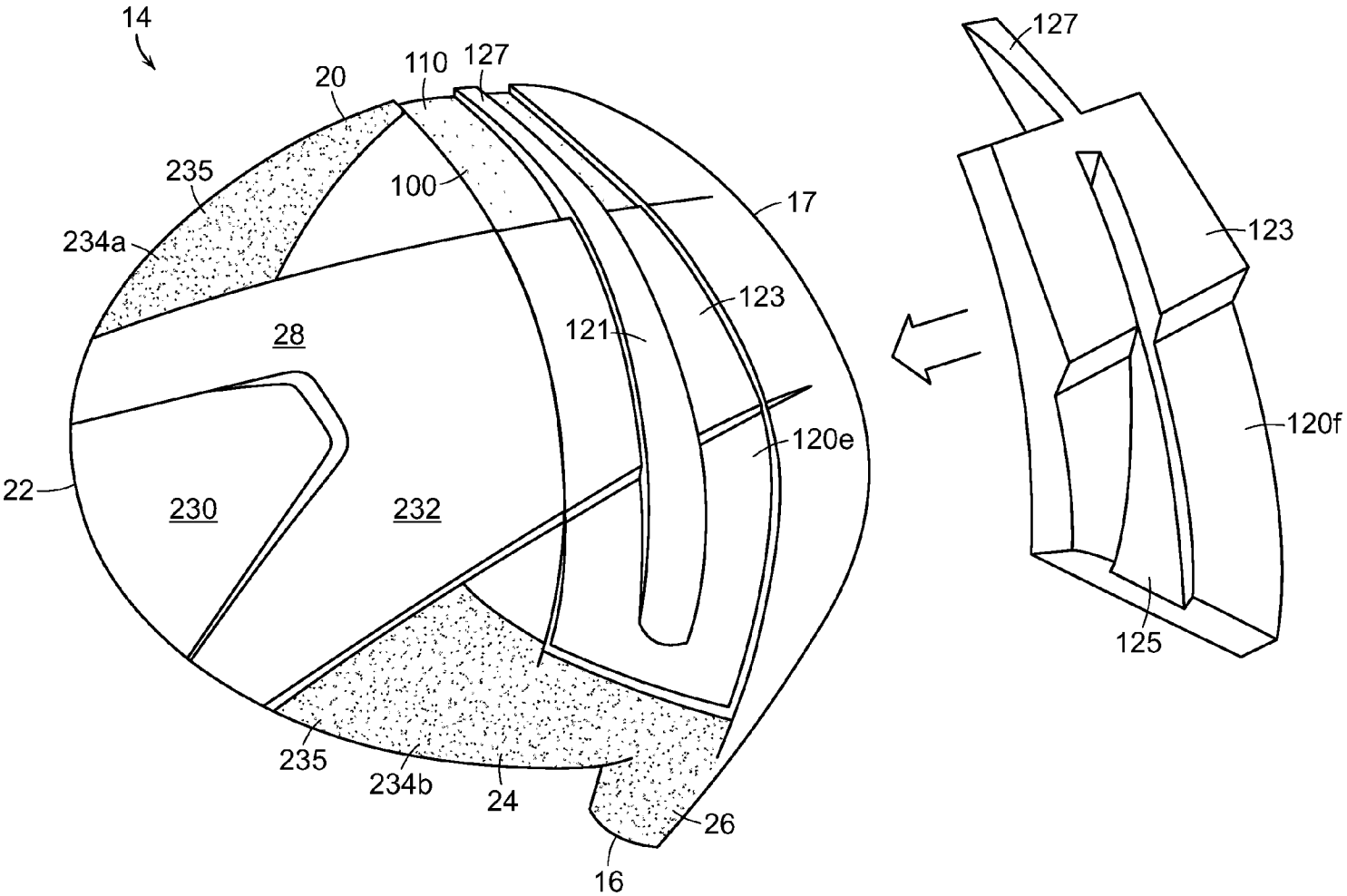
FIG. 9 is a perspective view of a club head with an insert received within the channel and with another insert configured for being received within the channel, according to other illustrative aspects.

According to even other aspects of the disclosure, the sole 28 of the club head 14 may include other features in addition to the channel 110 and the inserts 120, for example as best illustrated in FIG. 9. For example, a diffuser 230 may be provided in the rear portion of the sole 28. The cross-sectional area of diffuser 230 increases as the diffuser extends toward the rear 22. Thus, this particular diffuser configuration, orientation, and location may best act as a drag-reducing structure when the ball striking face 17 is leading the swing. Further, a central raised platform 232, extending from the front to the back of the club head 14 may be provided. In this particular embodiment, the platform 232 surrounds the diffuser 230 on three sides. Even further, in this particular embodiment, sole areas 234*a*, 234*b* may be provided with a coating 235. Sole area 234*b* merges into heel 24, which may also be provided with coating 235.

Insert 120*e* is shown secured within channel 110. Insert 120*e* includes a central raised portion or step 123, an elongated vane 121 and an extension 127. Insert 120*f* is configured for insertion into channel 110, and may be used as in interchangeable replacement for insert 120*e*. Insert 120*f* includes a central raised portion or step 123, an elongated channel 125 and an extension 127.

Figure 10:
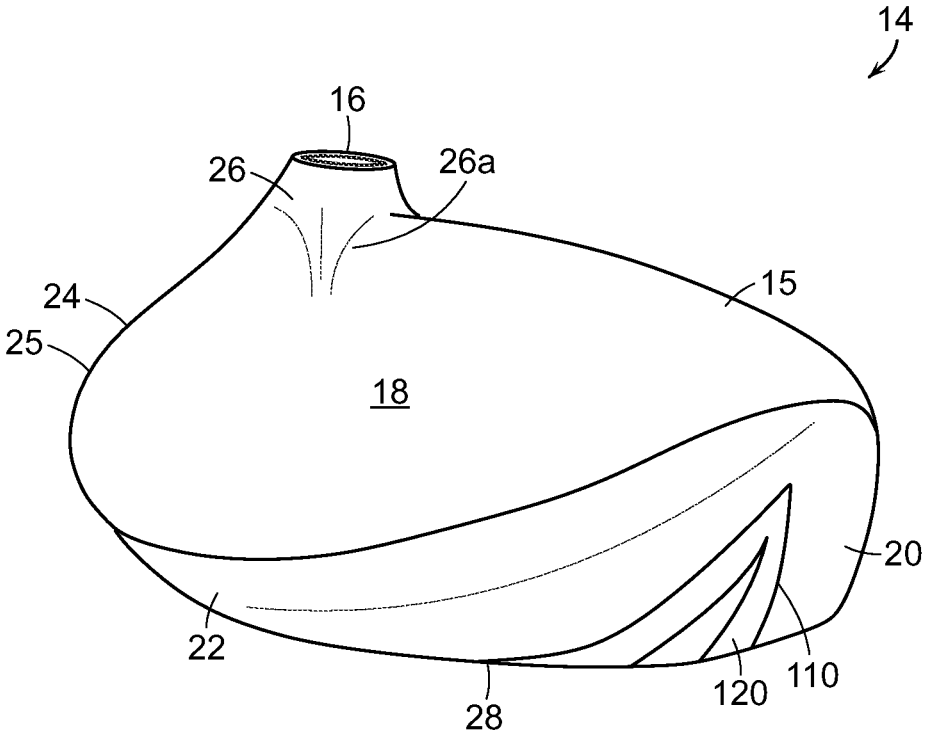
FIG. 10 is a perspective view of a golf club head according to another illustrative aspect.

FIG. 10 shows an embodiment where the channel 110 and the insert 120 extend into the toe 20.

While there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head for a metal wood type club, the club head comprising:

a body member having a ball striking face, a heel, a toe, a back, a crown, a sole, and a hosel region located at the intersection of the ball striking face, the heel and the crown;

the sole including a channel extending from the hosel region toward the toe; and an insert received within the channel, the insert defining a recess in its exposed surface; and means for detachably securing the insert to the channel.

2. The golf club head of claim 1, wherein the length of the channel extending from the hosel region toward the toe is at least 80% of the length of the club head.

3. The golf club head of claim 1, wherein the channel has a maximum width of greater than or equal to 20 mm.

4. The golf club head of claim 1, wherein the channel has a maximum depth of less than or equal to 6 mm.

5. The golf club head of claim 1, wherein the width of the channel decreases as it extends toward the toe.

6. The golf club head of claim 1, wherein the channel extends into the toe such that it can be viewed from the toe side when the club head is in the 60° lie angle position.

7. The golf club head of claim 1, wherein the length of the insert is at least 80% of the length of the club head.

8. The golf club head of claim 1, wherein the thickness of at least a portion of the insert is less than the depth of the channel.

9. The golf club head of claim 1, wherein the footprint of the insert is different than the footprint of the channel.

10. The golf club head of claim 1, wherein the insert has a surface region with a surface roughness of greater than or equal to 1.00 μm.

11. The golf club head of claim 1, wherein the recess forms an elongated feature extending generally in the heel-to-toe direction of the club head.

12. The golf club head of claim 1, wherein the insert is made of injection molded plastic.

13. The golf club head of claim 1, wherein the means for securing the insert to the channel includes at least one of threaded fastener, a snap fit mechanism, and a sliding mechanism.

14. The golf club head of claim 1, wherein the means for securing the insert to the channel includes an adhesive.

15. The golf club head of claim 1, wherein the body member has a height-to-length ratio of less than or equal to 0.50.

16. The golf club head of claim 1, wherein the body member has a height-to-volume ratio less than or equal to 0.120.

17. The golf club head of claim 1, wherein the body member has a breadth-to-volume ratio greater than or equal to 0.260.

18. The golf club head of claim 1, wherein the body member has a volume of greater than or equal to 420 cc.

19. The golf club head of claim 1, wherein the body member is teardrop shaped.

20. The golf club head of claim 19, wherein an angle, defined between a first tangent to the club head taken where the club head length lead-line at the outermost point of the heel intersects the profile of the ball striking face and a second tangent to the club head taken where the club head length lead-line at the outermost point of the heel intersects the profile of the heel, as viewed from above, ranges from approximately 80 degrees to approximately 90 degrees.

21. A golf club head for a metal wood type club, the club head comprising:

a metal body member having a generally pear shape having a first round end and a second round end when viewed from above, the first rounded end being more narrow than the second rounded end, the body member defining a ball striking face, a heel, a toe forming at least a portion of the second rounded end, a back forming at least a portion of the second rounded end, a crown having a generally smooth convex surface, a sole, and a hosel region forming at least a portion of the first rounded end and located at the intersection of the ball striking face, the heel and the crown;

the sole including a channel extending from proximate the hosel region toward the toe, the channel defining a surface having one of a protrusion and a notch; and a plastic injection-molded insert defining the other of the protrusion and the notch, the insert having a textured surface thereon and the insert being received within the channel, wherein the notch receives the protrusion to secure the insert to the channel.

22. The golf club head of claim 21, wherein the insert is selected from a plurality of inserts.

23. The golf club head of claim 21, wherein the channel has a width and wherein the channel width decreases from the hosel region towards the toe.

24. The golf club head of claim 21, wherein the channel has a depth and wherein the channel depth is constant.

25. The golf club head of claim 21, wherein the channel defines a pair of sidewalls, wherein the protrusion is located on the channel and comprises a plurality of protrusions located on the sidewalls, and wherein the notch is located on the insert and comprises a plurality of notches, the plurality of protrusions being received within the plurality of notches to secure the insert to the channel.

26. The golf club head of claim 25, wherein the channel defines an end wall, the end wall having a receptacle, the insert further having a projection, wherein the projection is received in the receptacle.

27. The golf club head of claim 21, wherein the insert is substantially trapezoidally-shaped.

28. The golf club head of claim 21, wherein the channel has a width and a length and wherein the insert extends the entire width of the channel and extends a partial length of the channel.

29. The golf club head of claim 21, wherein the channel has a depth and the insert has a step that extends outwardly from the channel.

30. The golf club head of claim 21, wherein a diffuser is included on the sole proximate the back of the body member.

* * * * *